US006025066A

United States Patent [19]

Terasawa et al.

[11] Patent Number: 6,025,066

[45] **Date of Patent: *Feb. 15, 2000**

[54] STENCIL SHEET ROLL AND A METHOD FOR PREPARING THE SAME

[75] Inventors: Hideki Terasawa; Hiroyo Kikuchi; Takayuki Kurosaki; Mitsuru Ujiie, all of Ibaraki-ken, Japan

[73] Assignee: Riso Kagaku Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/658,201

[22] Filed: Jun. 4, 1996

[30] Foreign Application Priority Data

Jun. 9, 1995 [JP] Japan ..... 7-143220
Jun. 9, 1995 [JP] Japan ..... 7-143221

[51] Int. Cl.[7] ..... B05C 17/06; B31F 1/00; B41N 1/24

[52] U.S. Cl. ..... 428/311.31; 101/128.21; 101/129; 156/184; 156/192; 156/194; 156/199; 264/175; 427/143; 428/311.71; 428/319.7; 428/906

[58] Field of Search ..... 428/311.31, 311.71, 428/319.7, 409, 906; 101/128.21, 129; 156/184, 192, 194, 199; 264/175; 427/143

[56] References Cited

U.S. PATENT DOCUMENTS 4,961,377 10/1990 Bando et al. .
5,219,637 6/1993 Arai et al. ..... 428/195
5,262,221 11/1993 Terada et al. ..... 428/195

FOREIGN PATENT DOCUMENTS 210040 1/1987 European Pat. Off. .
59-16790 1/1984 Japan .

OTHER PUBLICATIONS

Translation of JP 59–16790 Hattori et al., Jan. 1984.

*Primary Examiner*—Blaine Copenheaver
*Attorney, Agent, or Firm*—Fay, Sharpe, Fagan, Minnich & McKee

[57] ABSTRACT

The present invention provides a stencil sheet roll formed by winding up a stencil sheet to form a roll, the sheet including a thermoplastic resin film and a porous support laminated thereto, wherein the compression elastic modulus of the sheet is not less than 32 kg/cm$^2$. The invention also provides a stencil sheet roll formed by winding up a stencil sheet to form a roll, the sheet including a thermoplastic resin film and a porous support laminated thereto and having been subjected to calender treatment. Also disclosed is a method for manufacturing a stencil sheet roll comprising laminating a thermoplastic resin film to a porous support to form a stencil sheet, subjecting the stencil sheet to calender treatment, and winding up the calender-treated stencil sheet to form a roll. According to the present invention, excellent printing images can be obtained since compression elastic modulus of a stencil sheet is enhanced without impeding permeability of ink and thus deterioration in quality of images due to reduction in surface smoothness of the stencil sheet can be effectively prevented.

7 Claims, No Drawings

STENCIL SHEET ROLL AND A METHOD FOR PREPARING THE SAME

BACKGROUND OF THE INVENTION

1. Field of the Invention

The present invention relates to a stencil sheet roll and to a method for preparing the roll. More particularly, the invention relates to a stencil sheet roll in which smoothness of the surface of a stencil sheet which has been wound up in a roll is prevented from becoming deteriorated.

2. Description of the Related Art

A stencil sheet is prepared, for example, through laminating a thermoplastic resin film to a porous support using an adhesive, and applying a mold releasing agent onto the surface of the thermoplastic resin film so as to prevent melt-sticking of film. Stencil sheet rolls are manufactured by winding up the above-mentioned stencil sheets to form rolls. Stencil sheet rolls are set in automatic stencil making/printing device without being unwound for automatic stencil making and printing.

Presently, thermal printing head (TPH) are used to make stencils for stencil printing. In this case, if the surfaces of stencil sheets are rough, uniform contact cannot be obtained between TPH and a film, causing some parts to be easily perforated, and other parts to be not. As a result, images of the original text or drawing cannot be perforated at precise locations, and satisfactory printing images cannot be obtained. To avoid this shortcoming, it has been attempted to secure surface smoothness of a stencil sheet by the use of a porous support having good surface smoothness.

Meanwhile, in present-day stencil printing, stencil sheet rolls, i.e., stencil sheets wound up in rolls, are frequently used so as to enhance working efficiency. In this case, even though the stencil sheet has excellent surface smoothness in a flat sheet state, winding pressure applied to the sheet during winding to form a roll (generally 0.1–1.2 kg/cm$^2$) deteriorates surface smoothness as time passes. Therefore, stencil sheet rolls have an inherent drawback that they cannot maintain surface smoothness of flat stencil sheets. Smoothness of the surface of a stencil sheet roll is deteriorated because as time passes a portion of thermoplastic resin film that is not supported by fibers in a porous support gradually yields to form recesses under winding pressure of the stencil sheet which is wound in layers.

In order to solve this problem, a method has been proposed in which winding density of a roll is adjusted so as to prevent deterioration in smoothness of the surface of a stencil sheet (Japanese Patent Application Laid-Open (kokai) No. 6-239048). However, the approach of adjusting the winding density of a roll by itself is not effective in preventing deterioration of smoothness of a stencil sheet at interior portions of the roll where relatively high winding pressure is applied, particularly in the vicinity of the core of the roll. If winding pressure of the roll is reduced so as to avoid this drawback, another problem is caused in that handling of the roll becomes poorer.

SUMMARY OF THE INVENTION

In view of the foregoing, the present inventors conducted careful studies and found that deterioration in surface smoothness of a stencil sheet can be effectively prevented even when the sheet is wound to form a roll, provided that the compression elastic modulus of the stencil sheet is high; and that compression elastic modulus of a stencil sheet can be elevated, without impeding permeability of ink, by subjecting a manufactured stencil sheet to calender treatment. The present invention was achieved based on these findings.

Accordingly, an object of the present invention is to solve the above-mentioned problems entailed by the prior art and to provide a stencil sheet roll and a method for preparing the roll, the roll being capable of providing excellent printing images without reducing the quality of the images due to deterioration in surface smoothness.

In one aspect of the present invention, there is provided a stencil sheet roll formed by winding up a stencil sheet to form a roll, the sheet comprising a thermoplastic resin film and a porous support laminated thereto, wherein the compression elastic modulus of the sheet is not less than 32 kg/cm$^2$.

Preferably, the compression elastic modulus of the sheet is between 37 and 75.6 kg/cm$^2$.

In another aspect of the present invention, there is provided a stencil sheet roll formed by winding up a stencil sheet to form a roll, the sheet comprising a thermoplastic resin film and a porous support laminated thereto and having been subjected to calender treatment.

Preferably, the compression elastic modulus of the sheet which has been subjected to calender treatment is not less than 32 kg/cm$^2$.

Still preferably, the compression elastic modulus of the sheet is between 37 and 75.6 kg/cm$^2$.

In a further aspect of the present invention, there is provided a method for manufacturing a stencil sheet roll comprising laminating a thermoplastic resin film to a porous support to form a stencil sheet, subjecting the stencil sheet to calender treatment, and winding up the calender-treated stencil sheet to form a roll.

The above and other objects, features, and advantages of the present invention will become apparent from the following description.

DETAILED DESCRIPTION OF PREFERRED EMBODIMENTS

The stencil sheet roll of the present invention is obtained by winding up a stencil sheet prepared through laminating a thermoplastic resin film to a porous support using a known method, while applying a winding pressure of, for example, 0.1–1.2 kg/cm$^2$. According to the present invention, the compression elastic modulus of a stencil sheet to be wound to form a roll must be equal to or greater than 32 kg/cm$^2$. If the compression elastic modulus of a stencil sheet is excessively low, deterioration in surface smoothness of a stencil sheet cannot be prevented. In order to secure improved handling of a stencil sheet roll by raising winding pressure and in view of other considerations, the optimal compression elastic modulus is determined to be between 37 and 75.6 kg/cm$^2$.

In the present invention, the compression elastic modulus was basically determined based on JIS K7220: a compression stress—strain curve was first obtained, and on the straight segment of the curve, the following relation was applied to obtain the compression elastic modulus:

$$Ee=\delta\sigma/\delta\epsilon$$

wherein Ee represents the compression elastic modulus (kgf/cm$^2$ (kPa)), $\delta\sigma$ represents the difference in stress between two points on the straight segment of the curve, and $\delta\epsilon$ represents the difference in strain between the same two points, using the linear portion of the curve. In the present invention, however, measurement conditions were modified in the following respects in view that the test piece are stencil sheets.

(1) Width and length of a test piece: 30±1 mm (2) Height of a test piece: As the height used equaled to the thickness of 40 stencil sheets, i.e., the thickness of one stencil sheet multiplied by 40. The thickness of a test piece (stencil sheet) was determined according to JIS P8118 using a dial gauge-type micrometer having parallel plates. Measurement was performed at an ambient temperature of 20±2° C. and humidity of 62±2%. The measurements obtained for 10 stencil sheets layered one upon another were divided by 10.

(3) Speed: 1 mm/min.

(4) Compression strain: $\epsilon=(h-h_1)h_0$.

wherein e represents the compression strain, h represents the height at a zero-deformation point of a test piece, $h_1$ represents the height of the test piece subject to a compression load, and $h_0$ represents the original height of the test piece (mm). As $h_0$, the thickness of one test piece×40 was used.

(5) Compression elastic modulus: In order to exclude effects attributed to spaces between superposed stencil sheets, the difference in stress between two points on the straight segment was obtained from the straight segment beyond the stress level of 60 kg, not from the initial straight segment of the compression stress—strain curve.

Examples of thermoplastic resins which may be used in the present invention include, but are not limited to, known films such as films made of vinyl chloride/vinylidene chloride copolymers, polyamide films, ethylene/vinyl acetate copolymer films, polypropylene films, polyethylene phthalate films, and other polyester films. Of these, polyester films are particularly preferred from the viewpoints of applicability to thermal heads and ease in handling.

The thickness of a thermoplastic resin film is generally 0.5–10 $\mu$m .

Examples of porous supports which may be used in the present invention include, but are not limited to, papers made of a single species or combinations of natural fibers such as of Kozo (paper mulberry), Mitsumata (Edgeworthia papyrifera), ganpi, Manila hemp, and flax, or synthetic fibers such as of polyester, vinylon, acrylates, and rayon; and screen plain gauzes made of a single species or combinations of silk, nylon, polyester, etc. The thickness of a porous support is usually between 20 and 60 $\mu$m. The support may be treated with chemicals if desired.

The method for laminating a thermoplastic resin film and a porous support is not particularly limited. Although an adhesive is used in usual circumstances, it is not needed if it is carried on the thermoplastic resin film or the porous support.

Examples of adhesives include vinyl acetate resins, saturated polyester resins, vinyl chloride resins, vinylidene chloride copolymer resins, polyethylene resins, polypropylene resins and other polyolefin resins, acrylic resins, acrylate resins, methacrylate resins, polyurethane resins, epoxy resins, and polyol resins. They may be used either as a solution in a solvent or as they are. Alternatively, they may be set in the presence of water or by the application of light or electron beams. The amount of an adhesive is usually between 0.3 and 5 g/m$^2$.

The thermoplastic resin film in a stencil sheet may be subjected to common treatment so as to impart mold releasability, smoothness, or electrostatic properties thereto. Examples of mold releasing agents include silicones, fluorine-containing resins, and surfactants. The treatment for improving mold releasability is performed by applying a mold-releasing agent to a manufactured stencil sheet. Alternatively, mold releasability may be provided by incorporating a mold releasing agent into a film, a support, or an adhesive, which constitute a stencil sheet.

The method for producing the stencil sheet roll of the present invention is not particularly limited so long as the method achieves a compression elastic modulus of a stencil sheet to be wound up into a roll of not less than 32 kg/cm$^2$.

Preferably, a thermoplastic resin film and a porous support are laminated using a known method to form a flat stencil sheet, after which the resultant stencil sheet is subjected to calender treatment followed by winding up to form a roll. By subjecting a stencil sheet to calender treatment before the sheet is wound up into a roll, it is possible to raise the compression elastic modulus of the stencil sheet. As a result, even when the stencil sheet is wound up with a winding pressure applied for ordinary roll processing (0.1–1.2 kg/cm$^2$), surface smoothness of the stencil sheet is prevented from becoming deteriorated over time, thereby affording high quality printing images. In connection to this, compression elastic modulus can also be elevated by performing a calender treatment on a porous support during a prefabrication stage of a stencil sheet. However, in such as case, the density of the porous support will increase, thereby impeding smooth passage of ink therethrough. Moreover, when it is laminated with a film, contact points between the film and the support increase to hamper perforation through the film, resulting in a poor image quality in some cases.

For performing calender treatment, known calendering device may be used. In the determination of calendering conditions, in order to increase the compression elastic modulus of a stencil sheet without preventing permeability of ink, calendering pressure is suitably selected in accordance with the material of the porous support. For example, in the case where a stencil sheet including a Japanese paper made of a fibrous paper of a mixture of hemp and synthetic fibers and having a compression elastic modulus of 34.4 kg/cm$^2$ is calendered at a line pressure of 60–210 kg/cm and at a speed of 10–30 m/min, a compression elastic modulus of up to 39–44 kg/cm$^2$ can be achieved without impeding ink permeability. The calendering may be performed while applying heat. Generally, it is preferred that calendering be performed at around room temperature, in consideration of both the glass transition point and the starting point of shrinkage of the film. The materials and stages of calendering rolls may be arbitrarily determined in accordance with conditions of the calendering treatment.

EXAMPLES

The present invention will next be described by way of example, which should not be construed as limiting the invention.

Examples 1–6 and Comparative Example 1

Each porous support listed in Table 1, made of the fibers indicated and having the basis weight indicated, was laminated to polyester film having a thickness of 2 $\mu$m using an epoxy acrylate adhesive. On the polyester film surface of the resultant material, a silicone-containing releasing agent was applied to fabricate a stencil sheet. The amount of the adhesive was 0.6 g/m$^2$, and that of the releasing agent was 0.05 g/m$^2$.

TABLE 1

| | Fibers constituting the porous support | Basis weight of porous support (g/m$^2$) |
|---|---|---|
| Ex. 1 | Hemp/PET | 11.0 |
| Ex. 2 | Hemp/PET + calendering | 11.0 |
| Ex. 3 | Hemp/vinylon | 11.0 |
| Ex. 4 | Hemp | 9.7 |
| Ex. 5 | Hemp | 9.9 |
| Ex. 6 | PET | 12.0 |
| Comp. Ex. 1 | Hemp | 9.8 |

The thickness and compression elastic modulus of each of the resultant stencil sheets were measured. The results are shown in Table 2.

Subsequently, using each stencil sheet and a stencil-making/printing device (Risograph GR275 or Risograph RA225, trademarks, Riso Kagaku Corporation), stencil-making and printing were performed, and the quality of images of the obtained prints was checked. Similarly, a stencil sheet roll which was prepared by winding up the above each stencil sheet with a winding pressure of 1 kg/m$^2$ was also examined for the quality of images of obtained prints.

The quality of images of a print produced before and after winding up a stencil sheet was visually observed and assessed according to 3 rankings. The results are shown in Table 2. Those providing the best image quality were ranked "3", and those providing the poorest image quality were ranked "1".

TABLE 2

| | Compression elastic modulus (kg/cm$^2$) | Thickness stencil sheet (μm) | Assessment of image quality | | Plate-making/ printing device |
|---|---|---|---|---|---|
| | | | Before winding-up | After winding-up | |
| Ex. 1 | 34.6 | 44.8 | 3 | 2 | GR275 |
| Ex. 2 | 44.0 | 37.1 | 3 | 3 | do. |
| Ex. 3 | 39.3 | 42.0 | 3 | 3 | do. |
| Ex. 4 | 35.4 | 39.8 | 3 | 2 | RA225 |
| Ex. 5 | 35.1 | 48.4 | 3 | 3 | do. |
| Ex. 6 | 44.0 | 52.0 | 3 | 3 | do. |
| Comp. Ex. 1 | 30.9 | 34.8 | 2 | 1 | do. |

As is apparent from Table 2, reduction in quality of images after winding up was smaller in stencil sheets having higher compression elastic modulus (Examples 1 through 6) as compared to the stencil sheet having a low compression elastic modulus (Comparative Example 1), demonstrating that deterioration in smoothness of a rolled stencil sheet can be prevented.

Examples 7–11 and Comparative Example 2

Mixed japanese paper made of hemp and a synthetic resin (PET) was used as a porous support, and polyester film having a thickness of 2 μm was used as a thermoplastic resin film, and the two were laminated using an epoxy acrylate adhesive (amount of application: 0.6 g/m$^2$) to make a flat stencil sheet.

The resultant flat stencil sheet was subjected to calender treatment under conditions indicated in Table 3. The calender treatment performed was a one-stage treatment using a combination of two rolls, one being an elastic modulus roll made of plastic or cotton and the other being a tilt roll made of steel, at room temperature.

Compression elastic modulus of a stencil sheet before undergoing calender treatment (Comparative Example 2) and that of each stencil sheet which was calendered (Examples 7 through 11) were measured. The results are shown in Table 3. As is apparent from the Table, it was confirmed that the compression elastic modulus of a stencil sheet is enhanced by calender treatment. The thickness of each stencil sheet (μm ) and measurements of calender ratio are also shown in Table 3. The calender ratio is defined as (the thickness of a calendered stencil sheet)/(the thickness of a stencil sheet before being calendered)×100.

Subsequently, using a stencil-making/printing device (Risograph GR275, trademark, Riso Kagaku Corporation), each stencil sheet was subjected to stencil-making and printing, and the quality of images of the obtained prints was checked. Similarly, a stencil sheet roll which was prepared by winding up the above each stencil sheet with a winding pressure of 1 kg/m$^2$ was also examined for the quality of images of obtained prints.

The quality of images of a print produced before and after winding up a stencil sheet was visually observed and assessed according to 3 rankings. The results are shown in Table 3. Those providing the best image quality were ranked "3", and those providing the poorest image quality were ranked "1".

TABLE 3

| | Calendering conditions | | Compression elastic modulus (kg/cm$^2$) | Thickness of stencil sheet (μm) | Calender ratio (%) | Assessment of image quality | |
|---|---|---|---|---|---|---|---|
| | Line pressure (kg/cm) | Speed (m/min) | | | | Before winding-up | After winding-up |
| Ex. 7 | 100 | 10 | 44.0 | 37.1 | 92.8 | 3 | 3 |
| Ex. 8 | 210 | 30 | 40.0 | 31.5 | 82.8 | 3 | 3 |
| Ex. 9 | 60 | 10 | 39.4 | 32.1 | 79.8 | 3 | 3 |
| Ex. 10 | 140 | 10 | 41.0 | 32.3 | 83.7 | 3 | 3 |
| Ex. 11 | 210 | 10 | 43.0 | 37.5 | 94.3 | 3 | 3 |
| Comp. Ex. 2 | — | — | 34.4 | 45.5 | 100.0 | 3 | 2 |

As is apparent from Table 3, reduction in quality of images after winding up was smaller in calendered stencil sheets (Examples 7 through 11) as compared to the stencil sheet of Comparative Example 2, demonstrating that deterioration in smoothness of a stencil sheet can be prevented after the stencil sheet has been wound up into a roll.

Example 12 and Comparative Example 3

The procedure of Example 7 was repeated to produce stencil sheets except that japanese paper made of hemp fibers and having a thickness of 42.3 μm was used as the porous support, calender conditions employed were as shown in Table 4, and the stencil-making/printing device was Risograph RA225 (trademark, Riso Kagaku Corporation). The quality of images of the obtained prints was assessed. The results are shown in Table 4. In Comparative Example 3, a stencil sheet which was not calendered was used.

TABLE 4

| | Calendering conditions | | Compression on | Thickness of | | Assessment of | |
|---|---|---|---|---|---|---|---|
| | Line | | elastic | stencil | Calender | image quality | |
| | pressure (kg/cm) | Speed (m/min) | modulus ($kg/cm^2$) | sheet (μm) | ratio (%) | Before winding-up | After winding-up |
| Ex. 12 | 5 | 5 | 34.7 | 40.0 | 93.4 | 3 | 3 |
| Comp. Ex. 3 | — | — | 34.1 | 43.2 | 100.0 | 3 | 2 |

As is apparent from Table 4, reduction in quality of images after winding up the stencil sheet of the present invention was small, thereby demonstrating that the surface smoothness of stencil sheets of the present invention is not deteriorated over time even when they are wound up into rolls.

As described above, according to the present invention directed to the above-described stencil sheet roll and the method for fabricating the roll, compression elastic modulus of a stencil sheet can be improved without impeding the permeability of ink. Thus, it is possible to prevent deterioration of images of prints attributed to the reduction in surface smoothness of the stencil sheet which has been wound up into rolls, producing excellent print images.

What is claimed is:

1. A stencil sheet roll formed by winding up a stencil sheet to form a roll, the sheet comprising a thermoplastic resin film and a porous support laminated thereto wherein sheet is compressed at a line pressure of 60–210 kg/cm, wherein the compression elastic modulus of the sheet is not less than 32 $kg/cm^2$.

2. The stencil sheet roll according to claim 1, wherein the compression elastic modulus of the sheet is between 37 and 75.6 $kg/cm^2$.

3. A stencil roll formed by winding up a stencil sheet to form a roll, the sheet comprising a thermoplastic resin film and a porous support laminated thereto and having been subjected to calender treatment at a line pressure of 60–210 kg/cm at around room temperature wherein the compression elastic modulus of the sheet after calendering is not less than 32 $kg/cm^2$.

4. The stencil sheet roll according to claim 3, wherein the compression elastic modulus of the sheet is between 37 and 75.6 $kg/cm^2$.

5. A stencil sheet formed by winding up a stencil sheet to form a roll in an automatic stencil making-printing device, the sheet comprising a thermoplastic resin film and a porous support laminated thereto, wherein the compression elastic modulus of the sheet is between 37 and 75.6 $kg/cm^2$.

6. A stencil sheet roll formed by winding up a stencil sheet to form a roll in an automatic stencil making-printing device, the sheet comprising a thermoplastic resin film and a porous support laminated thereto and having been subjected to calendar treatment at around room temperature, wherein the compression elastic modulus of the sheet after calendering is between 37 and 75.6 $kg/cm^2$.

7. A method for manufacturing a stencil sheet roll comprising laminating a thermoplastic resin film to a porous support to form a stencil sheet, subjecting the stencil sheet to calender treatment at a line pressure of 60–210 kg/cm at around room temperature wherein the compression elastic modulus of the sheet after calendering is not less than 32 $kg/cm^2$, and winding up the calender-treated stencil sheet to form a roll.

* * * * *